US007698139B2

(12) United States Patent
Obert et al.

(10) Patent No.: US 7,698,139 B2
(45) Date of Patent: Apr. 13, 2010

(54) METHOD AND APPARATUS FOR A DIFFERENTIATED VOICE OUTPUT

(75) Inventors: Georg Obert, Munich (DE); Klaus-Josef Bengler, Regenstauf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 582 days.

(21) Appl. No.: 10/465,839

(22) Filed: Jun. 20, 2003

(65) Prior Publication Data

US 2003/0225575 A1 Dec. 4, 2003

Related U.S. Application Data

(63) Continuation of application No. PCT/EP01/13488, filed on Nov. 21, 2001.

(30) Foreign Application Priority Data

Dec. 20, 2000 (DE) ..... 100 63 503

(51) Int. Cl.
*G10L 13/00* (2006.01)

(52) U.S. Cl. ..... 704/258; 704/260; 704/269; 704/278

(58) Field of Classification Search ..... 704/258–278
See application file for complete search history.

(56) References Cited

U.S. PATENT DOCUMENTS

| | | | | |
|---|---|---|---|---|
| 5,559,927 | A | 9/1996 | Clynes | |
| 5,834,670 | A * | 11/1998 | Yumura et al. | 84/610 |
| 5,924,068 | A * | 7/1999 | Richard et al. | 704/260 |
| 6,181,996 | B1 * | 1/2001 | Chou et al. | 701/36 |
| 6,539,354 | B1 * | 3/2003 | Sutton et al. | 704/260 |
| 6,738,457 | B1 * | 5/2004 | Pickering et al. | 379/88.16 |
| 2001/0044721 | A1 * | 11/2001 | Yoshioka et al. | 704/258 |
| 2002/0087655 | A1 * | 7/2002 | Bridgman et al. | 709/217 |

FOREIGN PATENT DOCUMENTS

| | | |
|---|---|---|
| DE | 30 41970 A1 | 5/1981 |
| EP | 0901000 A2 | 3/1999 |
| WO | WO00/23982 | 4/2000 |

OTHER PUBLICATIONS

Rutledge, J.C. et al., "Synthesizing Styled Speech Using the Klatt Synthesizer" (ICASSP), May 9-12, 1995, pp. 648-651.
Klatt, D.H., "Review of Text-to-Speech Conversion for English" *J. Acoust. Soc. Am* 82(3), Sep. 1987, pp. 737-762.

* cited by examiner

*Primary Examiner*—Qi Han
(74) *Attorney, Agent, or Firm*—Crowell & Moring LLP

(57) ABSTRACT

In a method and apparatus for a differentiated voice output, systems existing in a vehicle, such as the on-board computer, the navigation system, and others, can be connected with a voice output device. The voice outputs of different systems can be differentiated by way of voice characteristics.

14 Claims, 1 Drawing Sheet

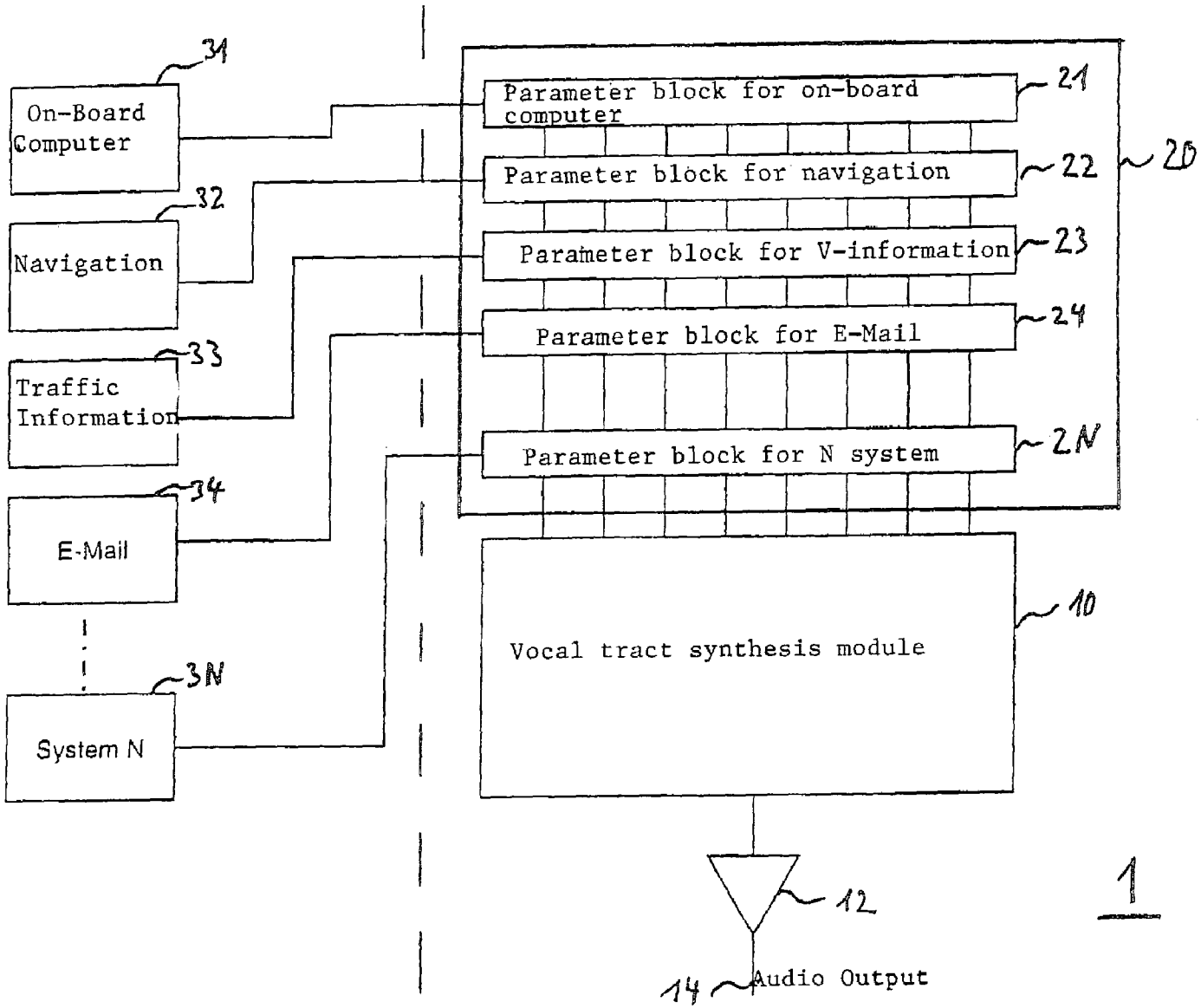
20
21
22
23
24
2N
10
1
Parameter block for on-board computer
Parameter block for navigation
Parameter block for V-information
Parameter block for E-Mail
Parameter block for N system
Vocal tract synthesis module
12
Audio Output
14
31
32
33
34
3N
On-Board Computer
Navigation
Traffic Information
E-Mail
System N

METHOD AND APPARATUS FOR A DIFFERENTIATED VOICE OUTPUT

CROSS-REFERENCE TO RELATED APPLICATIONS

This application is a continuation of PCT Application No. PCT/EP01/13488 filed on Nov. 21, 2001 corresponding to German priority application 100 63 503.2, filed Dec. 20, 2000, the disclosure of which is expressly incorporated by reference herein.

BACKGROUND AND SUMMARY OF THE INVENTION

The present invention relates to a method and apparatus for a differentiated voice output or voice production as well as a system which incorporates the same, and to combinations of a voice output device with at least two systems, particularly for a use in a vehicle.

Individual vehicle systems frequently have an acoustic man-machine interface for the voice output. In such systems, a voice output module is assigned directly, usually using voice-producing methods based on pulse-code modulation (=PCM), in which a subsequent compression (for example, MPEG) may be connected. Other systems use voice synthesis methods which form words and sentences (signal manipulation) mainly by way of the compilation of syllable segments (phonemes).

The above-mentioned voice output methods are speaker dependent, requiring that the same human speaker always be used for recordings when the word or text range is to be expanded. Furthermore, like a high-quality phoneme synthesis by signal manipulation, PCM methods require considerable storage space for filing texts or syllable segments. In both methods, the storage space requirement is considerably increased when different national languages are to be outputted.

Furthermore, methods are known which are based on a complete synthesis of the language, particularly by converting the human vocal tract as an electrical equivalence, and using a sound generator and several filters on the output side (source—filter model). One device operating according to this method is a so-called characteristic-frequency synthesizer (for example, KLATTALK). Such a characteristic-frequency synthesizer has the advantage that voice-characteristic features can be influenced.

One object of the present invention is to provide a method and apparatus which can achieve a differentiated voice output.

Another object of the invention is to provide a system that uses the voice output method and apparatus.

Still another object of the invention is to provide a combination of a voice output device with at least two systems, particularly for a use in vehicles.

These and other objects and advantages are achieved by the method and apparatus according to the invention, which has the advantage that a single voice output device or voice synthesis device can achieve voice outputs for different systems, with each system being identifiable by voice-characteristic differences.

According to a preferred embodiment of the invention, a parameter block is assigned to each system and is used by the voice synthesis device during a voice output from this system. For example, a first parameter block is provided for an on-board computer; a second parameter block is provided for a navigation system; a third parameter block is provided for traffic information; or a fourth parameter block is provided for a TTS system (Text-to-Speech System), such as may be used for e-mail system. Furthermore, one or more additional parameter blocks are provided for additional systems.

The voice synthesis device produces the voice output as a function of the assigned parameter block, for example, with a soft female voice for a navigation system, or with a hard male bass for the voice output of traffic reports.

According to a preferred embodiment of the invention, a method and an apparatus are used for a full synthesis of the voice, preferably a characteristic-frequency synthesizer. The control parameters for the synthesizer are divided into classes. One class of dynamic parameters controls the articulation, like the movement of the voice tract during the speaking. A second class of static parameters controls speaker-characteristic features, such as the fundamental frequency of the generator and fixed characteristic frequencies which are formed in the case of a child, a woman or a male speaker as a result of the different geometrical dimension of the voice tract.

An expanded model of the characteristic-frequency synthesizer can achieve a separate generation of voiced and unvoiced sounds. As a result of further parameters, additional resonators or attenuators can be connected or the dynamic parameters for the articulation can be influenced.

The method and apparatus according to the invention are especially suitable for use in systems of a vehicle. For a voice output, each system has two possibilities for controlling the voice output. The first comprises sending an output of control commands for the voice articulation, the sequence of the control parameters for words, sentences and sentence sequences being stored in the system. In the second, a second output switches a parameter block which determines the speaker characteristic.

As an alternative, or in addition, it is also possible to store this parameter data block directly in the system and, in the case of a required voice output, load the parameter data block into the voice synthesis device.

According to a further preferred embodiment, which can be used as an alternative or in addition to the above-mentioned embodiments, for the differentiation of the information sources (that is, of the systems which carry out a voice output), the generator and characteristic-frequency parameters can also be dynamically changed. As a result, audible differences in the prosody can be obtained, such as the duration and/or emphasis of syllable segments and/or the melody of the sentence. Specifically, a prosodic modulation can be utilized as a function of, for example, a traffic condition or a traffic situation for the voice output of announcement texts. Finally, the significance of an information can be expressed by modulating the voice.

The invention has the advantage that, for example, in a vehicle, only a single voice generator with a small parameter memory can be controlled by several information sources. In this case, the information sources can be equipped with different voice characteristics.

When a full synthesis device is used, such as a vocal-tract synthesis device, the method is speaker-independent and high-quality studio recordings are not required.

In an expanded characteristic-frequency synthesizer, an emotional expression in the voice can also be added according to the invention.

The voice characteristic can be changed using prefabricated parameter masks, in a very simple manner. The method is also suitable for the conversion of free texts to speech, for example, the reading of e-mail.

Other objects, advantages and novel features of the present invention will become apparent from the following detailed description of the invention when considered in conjunction with the accompanying drawings.

BRIEF DESCRIPTION OF THE DRAWINGS

The single FIGURE of drawing is a schematic diagram of a preferred embodiment of the invention for a differentiated voice output with several systems according to the invention.

DETAILED DESCRIPTION OF THE DRAWINGS

The preferred embodiment of the invention illustrated in FIG. 1 has a voice output unit 1 with a voice synthesis device 10 in the form of a vocal-tract synthesis module, based on a full synthesis of the voice. (For example, a characteristic-frequency synthesizer, such as KLATTALK, can be used.) The voice synthesis device 10 is connected with an amplifier 12 whose output 14 supplies an audio signal which emits voice by way of a loudspeaker (not shown).

N parameter blocks 21, 22 to 2N are assigned to the voice synthesis device 10 and, in the illustrated embodiment, are stored in a memory 20 of the voice output unit 1. Furthermore, N systems 31, 32 to 3N are shown, each of which is connected with the voice output unit 1 by way of a data connection, such as individual lines, a bus system or data channels. Each system can carry out a data output via the data output unit.

In greater detail, the following systems are present: An on-board computer 31 with a pertaining parameter block for the on-board computer 21; a navigation system 32 with a pertaining parameter block for the navigation 22; a traffic information system 33 with a pertaining parameter block for the traffic information 23; an e-mail system 34, with a pertaining parameter block for e-mail 24. Additional systems 3N may be provided which have a respective assigned parameter block 2N.

In the illustrated embodiment, it is possible by using a single voice output unit 1 to let the navigation system 32, for example, speak with a soft female voice which is determined by means of the parameter block for the navigation system 22. Furthermore, a parameter block 23 may be provided, for example, for traffic reports by means of which a hard male bass is used for the voice output.

The voice outputs may take place in time sequence corresponding to the input order for the voice output from the systems. Information of a higher priority, such as traffic information in the event of dangerous situations, such as incorrect driving, is first emitted for each voice output. Especially preferably, information of the highest priority, such as from the on-board computer concerning a malfunctioning of the vehicle or a start of slippery road conditions, are emitted immediately, in which case an ongoing voice output can be interrupted. The interrupted voice output can then be concluded or can be repeated.

The invention has the advantage that systems with an acoustic indication provide the driver with information from different systems without diverting the driver's attention from his task, such as occurs during visual displays. Costs can be saved by using a voice synthesis device which can be used by different on-board computers. In comparison to previously used voice-producing methods, for example, in the case of navigation systems, the storage space requirement can be reduced. The invention can be used with particular advantage in motor vehicles.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A vehicle information system comprising:

a plurality of systems, each of which outputs information to be transformed into audible speech, said plurality of systems including at least two systems selected from among a navigation system, a traffic information system, an email system and an onboard vehicle computer system; and a device for generating differentiated audible speech; wherein:

the device is connectable for selective communication with at least first and second systems of said plurality of systems, for generating audible speech as a function of information output by each of said systems, said audible speech having voice characteristics that are a function of data contained in respective parameter blocks which are stored in a memory and are assigned to said systems;

a first parameter block for producing a first voice characteristic is assigned to an output of the first system;

a second parameter block for producing a second voice characteristic is assigned to an output of the second system;

the second voice characteristic audibly differs from the first voice characteristic;

the device for generating differentiated audible speech comprises a voice synthesis device coupled in data communication to a memory containing said parameter blocks, including dynamic parameters and static parameters;

the dynamic parameters control articulation, corresponding to movement of a voice tract, and the static parameters control voice-characteristic features;

the static parameters have a fundamental frequency of a generator and/or fixed characteristic frequencies which correspond to the different geometrical dimensions of the voice tract of different speakers;

at least one of generator and characteristic frequency parameters for the voice output from a particular system can be dynamically changed; and dynamic change of said at least one of generator and characteristic frequency parameters causes audible differences in prosody, including at least one of duration and emphasis of syllable segments, and sentence melody in said audible speech; and said differences in prosody are implemented as a function of vehicle operating conditions.

2. The vehicle information system according to claim 1, wherein said vehicle operating conditions include at least traffic conditions.

3. The vehicle information system according to claim 1, wherein said differences in prosody are implemented as a function of significance of information which is communicated.

4. The vehicle information system according to claim 3, wherein said differences in prosody provide an emotional expression of the voice.

5. The vehicle information system according to claim 1, wherein said vehicle operating conditions comprise at least one of a traffic condition and a traffic situation.

6. A vehicle information system comprising:

a plurality of systems each of which outputs information that is to be transformed into audible speech, said plurality of systems including at least two systems selected from among a navigation system, a traffic information system, an email system and an onboard vehicle computer system;

a voice synthesizer;

a memory coupled to said voice synthesizer, said memory having stored therein a plurality of parameter blocks; wherein each parameter block is associated with a respective one of said systems;

each parameter block includes voice synthesis information for causing said voice synthesizer to generate audible voice signals having voice characteristics that are a function of information output from the respective system with which it is associated;

said voice characteristics differ audibly as between the respective systems;

control parameters stored in said voice synthesizer include dynamic parameters and static parameters;

the dynamic parameters control articulation, corresponding to movement of a voice tract, and the static parameters control voice-characteristic features;

the static parameters have a fundamental frequency of a generator and/or fixed characteristic frequencies which correspond to the different geometrical dimension of the voice tract of different speakers;

at least one of generator and characteristic frequency parameters for the voice output from a particular system can be dynamically changed; and dynamic change of said at least one of generator and characteristic frequency parameters causes audible differences in prosody, including at least one of duration and emphasis of syllable segments, and sentence melody in said audible speech; and said differences in prosody are implemented as a function of vehicle operating conditions.

7. The vehicle information system according to claim 6, wherein said vehicle operating conditions include at least traffic conditions.

8. The vehicle information system according to claim 6, wherein said differences in prosody are implemented as a function of significance of information which is communicated.

9. The vehicle information system according to claim 8, wherein said differences in prosody provide an emotional expression of the voice.

10. The vehicle information system according to claim 6, wherein said vehicle operating conditions comprise at least one of a traffic condition and a traffic situation.

11. A method for generating differentiated voice signals from a plurality of systems each of which systems outputs information that is to be transformed into audible speech, said plurality of systems including at least two systems selected from among a navigation system, a traffic information system, an email system and an onboard vehicle computer system, said method comprising:

for each particular system, storing in a memory a parameter block containing voice synthesis information for causing a speech synthesizer to generate audible voice signals which communicate speech corresponding to said information output from that particular system, said voice signals having voice characteristics determined by said voice synthesis information contained in said parameter block, which voice characteristics vary audibly as between said systems;

for each particular system said speech synthesizer using said voice synthesis information contained in the parameter block stored for that particular system, to generate said audible voice; and dynamically changing said voice characteristics as a function of operating conditions of said vehicle.

12. The method according to claim 11, wherein said vehicle operating conditions comprise at least one of a traffic condition and a traffic situation.

13. An information interface system for a vehicle, said system comprising:

a voice synthesis module; and a plurality of information systems which communicate by audible voice communication with an operator of said vehicle, via said voice synthesis module; wherein, each particular information system has a voice associated therewith which voice differs from voices of the other information systems, and by which a voice communication via said voice synthesis module can be recognized and identified by said operator, as emanating from said particular information system;

each of said voices is characterized by voice characteristics that are a function of data contained in a separate parameter block;

said parameter blocks are stored in a memory that is accessible by said voice synthesis module; and said voice characteristics are dynamically changed as a function of operating conditions of said vehicle.

14. The information interface system according to claim 13, wherein said vehicle operating conditions comprise at least one of a traffic condition and a traffic situation.

* * * * *